US009750319B2

(12) United States Patent
Mueller-Heumann

(10) Patent No.: US 9,750,319 B2
(45) Date of Patent: Sep. 5, 2017

(54) SINGLE SHEET TEMPLATE FOR FOLDING TO FORM A WALLET, A WALLET, AND A METHOD OF MAKING A WALLET FROM A SINGLE SHEET TEMPLATE

(71) Applicant: Michael Mueller-Heumann, London (GB)

(72) Inventor: Michael Mueller-Heumann, London (GB)

(73) Assignee: FOLDAGE LIMITED, London (GB)

( * ) Notice: Subject to any disclaimer, the term of this patent is extended or adjusted under 35 U.S.C. 154(b) by 164 days.

(21) Appl. No.: 14/473,275

(22) Filed: Aug. 29, 2014

(65) Prior Publication Data

US 2015/0075683 A1 Mar. 19, 2015

(51) Int. Cl.
*A45C 7/00* (2006.01)
*A45C 1/06* (2006.01)

(52) U.S. Cl.
CPC ..... *A45C 1/06* (2013.01); *A45C 7/00* (2013.01); *A45C 7/0095* (2013.01); *A45C 2001/065* (2013.01); *A45C 2007/0004* (2013.01)

(58) Field of Classification Search
CPC ..... A45C 1/06; A45C 7/00; A45C 7/0095; A45C 2001/065; A45C 2007/0004
See application file for complete search history.

(56) References Cited

U.S. PATENT DOCUMENTS 528,420 A * 10/1894 Estlow ..... A45C 1/06 150/149
528,421 A * 10/1894 Estlow ..... A45C 1/06 150/149
775,285 A * 11/1904 McDonald ..... B65D 5/643 150/143
2,437,534 A * 3/1948 Jackler ..... A45C 1/00 150/127
2,489,364 A * 11/1949 Broughton ..... A45C 1/06 150/138
2,552,932 A * 5/1951 Broughton ..... A45C 1/06 150/146
2,634,777 A * 4/1953 Berger ..... A45C 11/18 150/138

(Continued)

FOREIGN PATENT DOCUMENTS

CN 201365623 Y 12/2009
CN 202635855 U 1/2013
KR 101167158 B1 8/2012

*Primary Examiner* — Tri Mai
(74) *Attorney, Agent, or Firm* — Timothy E. Siegel; Timothy E. Siegel Patent Law, PLLC

(57) ABSTRACT

A single sheet template for folding to form a wallet with at least two card pockets. The template comprises: a) first and second pocket forming fold lines (16*a*, 16*b*) foldable in a z-fold to form inner and outer sheet portions of each of inner and outer card pockets and a bottom for each of the inner and outer card pockets, the bottom joining said inner and outer sheet portions; b) pocket side forming means (18*a*, 18*c*) foldable to form a first side of each of the inner and outer card pockets; c) a wallet edge fold line (18*b*) transverse to the first and second pocket forming fold lines and along which first and second segments (20*a*, 20*b*) of the template are foldable to form a second side of each of the inner and outer card pockets; and d) securing means (24*a*, 24*b*) for preventing unfolding along the wallet edge fold line.

18 Claims, 6 Drawing Sheets

(56) References Cited

U.S. PATENT DOCUMENTS

| | | | | |
|---|---|---|---|---|
| 3,251,532 | A * | 5/1966 | Hechtman | B65D 5/0005 229/101 |
| 3,903,945 | A | 9/1975 | Skeba | |
| 4,331,290 | A * | 5/1982 | Benham | B65D 27/08 229/72 |
| 2012/0312435 | A1 | 12/2012 | Chueh | |

* cited by examiner

SINGLE SHEET TEMPLATE FOR FOLDING TO FORM A WALLET, A WALLET, AND A METHOD OF MAKING A WALLET FROM A SINGLE SHEET TEMPLATE

FIELD OF THE INVENTION

The invention relates to a single sheet template for folding to form a wallet. The invention also relates to a wallet formed from such a template and a method of folding a single sheet template into a wallet.

BACKGROUND

It is known to make wallets from various materials. For example, a conventional wallet may be formed from pieces of leather sewn together at seams. It is generally desirable to make wallets in an inexpensive and simple manner. It is also generally desirable for wallets to be thin and to be able to carry cards, such as bank cards, and paper money (bills).

It is known to make wallets from sheet material. An example of a suitable thin, durable synthetic material is Tyvek®, and it is known to make wallets from Tyvek. It is an object of the present invention to provide an improved wallet in view of the above-mentioned issues.

SUMMARY OF THE INVENTION

In accordance with a first aspect of the present invention, there is provided a single sheet template for folding to form a wallet with at least two card pockets, the template comprising: a) first and second pocket forming fold lines foldable in a z-fold to form inner and outer sheet portions of each of inner and outer card pockets and a bottom for each of the inner and outer card pockets, the bottom joining said inner and outer sheet portions; b) pocket side forming means foldable to form a first side of each of the inner and outer card pockets; c) a wallet edge fold line transverse to the first and second pocket forming fold lines and along which first and second segments of the template are foldable to form a second side of each of the inner and outer card pockets; and d) securing means for preventing unfolding along the wallet edge fold line.

Advantageously, the z-fold enables formation of inner and outer card pockets. Further, a wallet made according to said template may be thinner than prior art wallets since there may be fewer layers of material. Usefully, all visible surfaces of the wallet may be formed of a single side of the template. Accordingly, the template need only be printed on a single side. This reduces production cost and facilitates customisation.

Notably, the segments being folded together about the wallet edge fold line serves to prevent the z-fold from unfolding.

The wallet can usefully have only a slightly larger area, as defined by length by width of the built wallet, than the side of a typical card, for example a credit card that it is to retain. Accordingly, the wallet can be made of a convenient size.

An outer card pocket is especially desirable on a wallet since many persons often use cards in RFID systems, for example in payment systems, building entry systems, or public transport systems. Such cards can be more effectively used when present in an outer pocket without the card being removed from the wallet, whereas if the card is in an inner pocket, communication in an RFID system may be prevented. When multiple RFID cards are held within the same wallet, it may be necessary to remove and present the specific card intended to be used, in order to avoid an incorrect or invalid card being detected by the RFID reader. For this purpose, and more generally, the outer pocket is very useful for cards that need to be taken out frequently.

The template may be for forming a multi-fold wallet, and may comprise a hinge fold line along which the multi-fold wallet is to be opened and closed in use, located adjacent and spaced from an opening to said inner pocket, whereby disengagement of a card from the inner pocket is prevented when the wallet is closed. Since the hinge fold line is located adjacent and spaced from the opening of the inner card pocket, cards cannot accidentally come loose from the inner pocket when the wallet is closed. Preferably, the opening to the inner card pocket extends lengthwise with respect to the hinge fold line.

Optionally, the template may be provided in sheet form to a consumer and folded into a wallet by the consumer. Manufacture may thus be very inexpensive. The template may be provided in a kit, also including instructions on how to fold the template. Additionally or alternatively, the template may include instructions printed on it.

The first and second pocket forming lines may be substantially perpendicular to the wallet edge fold line. Where the built wallet is a multi-fold wallet, each segment may comprise at least two portions. Each portion may be rectangular or square, preferably corresponding in shape but slightly larger than the side areas of the cards that the wallet is to retain.

The securing means is preferably foldable to prevent unfolding along said wallet edge fold line. While the wallet can be very thin, it can also be small compared to prior art wallets in the other two dimensions. This is because, in comparison to a conventionally constructed wallet, no stitching, taping or gluing is needed around edges.

The pocket side forming means may comprise: two further wallet edge fold lines transverse to said first and second pocket forming fold lines, a one of said further wallet edge fold lines being on respective opposite sides of said wallet edge fold line; and first and second parts, for example third and fourth segments, respectively foldable along each of said further wallet edge fold lines to respectively form said first side of each of the inner and outer card pockets. The securing means may be also arranged to prevent unfolding along said two further wallet edge fold lines.

Preferably, the template further comprises a first slit extending lengthwise with respect to said hinge fold line in a first section of the wallet on an opposite side of the hinge fold line to a second section comprising the inner and outer card pockets, wherein the first slit forms an opening of a third card pocket. Thus, advantageously, the built wallet has an additional card pocket. Further, since the slit of the card wallet permits insertion and removal of the cards from the side of the second section, accidental dislodgement of the cards from the card wallet when the wallet is closed is prevented. This is particularly important if the template is formed from a material against which cards have little friction.

The securing means preferably comprises a first flap arranged for folding into the first slit, thereby to at least partially secure the template folded along at least the wallet edge fold line. Thus the template can be conveniently secured in its folded configuration as a wallet, without need for tape or glue or stitching.

The first flap may include a tab portion foldable along a tab fold line, wherein the first flap is foldable along a flap fold line against the portion of the first section in which the first slit is provided, and said tab portion is foldable along said tab fold line and insertable into the first slit, thereby to secure the template folded along at least the wallet edge fold line.

The template may further comprise an edge concealing portion extending from at least one side of the flap, wherein the wallet edge fold line extends to divide the edge concealing portion from the flap, wherein the edge concealing portion is foldable against the flap with the folding of the first and second segments along the wallet edge fold line.

The template may further comprise a further hinge fold line, the wallet being foldable about said further hinge fold line to open and close, wherein the further hinge fold line is on a side of the inner and outer card pockets remote from the hinge fold line, whereby the template is foldable about the hinge and further hinge fold lines. With the hinge and further hinge fold lines, the wallet is a trifold wallet, the inner and outer pockets being in a second, middle section thereof. The template may include further sections separated by yet further hinge fold lines.

The template may further comprise a second slit extending lengthwise with respect to the further hinge fold line, in a third section of the wallet on an opposite side of the further hinge fold line to the second section comprising the inner and outer card pockets, wherein the second slit forms an opening of a fourth pocket. Thus, advantageously, the built wallet has an additional card pocket.

The securing means may further comprise a second flap arranged for folding into the second slit, thereby to at least partially secure the template folded along at least the wallet edge fold line. Thus, again, the template can be conveniently secured at its other side when its folded configuration as a wallet, without need for tape or glue or stitches.

The first and/or second slits may respectively be openings to an inner pocket in the first and third sections of the trifold wallet. Alternatively, one or both of the first and second slits may respectively be provided in portions of the first and third sections that form the exterior of the wallet, so as to be outer pockets. However, advantageously, where one or both is provided as an opening of an inner pocket, the opening can be located so that the respective hinge or further hinge fold line extends substantially lengthwise therewith, is adjacent and is spaced from the opening to permit the pocket to carry cards, but prevent accidental dislodging of the cards when the wallet is closed.

The folding of the template along the wallet edge fold line preferably forms a note pocket, wherein the first and second segments joined by the wallet edge fold line form the note pocket. The template may further comprise at least one yet further fold line substantially parallel to said wallet edge fold line, wherein said yet further fold line is foldable to provide a divider in the note pocket. Two yet further fold lines may be provided to enable a z-fold to provide a divider. Such a divider has a tidier appearance and is stiffer than a divider that comprises end portions of the template.

In accordance with a second aspect of the present invention, there is provided a wallet as defined in claim 16.

In accordance with a third aspect of the present invention, there is provided a method as defined in claim 18.

In accordance with a fourth aspect of the present invention, there is provided a single sheet template for folding to form a wallet having at least one card pocket, said template including: a wallet edge fold line along which first and second portions of the template can be folded; a slit in the first portion, arranged to form an opening of a card pocket; and a flap extending from the second portion and arranged for folding to engage with the slit when said first and second portions are folded along the wallet edge fold line, thereby to prevent unfolding along said wallet edge fold line. The template may advantageously be secured as a wallet without use of glue, stitching or tape.

The flap may include a tab portion foldable along a tab fold line. In this case, the flap may be foldable against the first portion and the tab portion may be foldable along the tab fold line and insertable into said slit, thereby to secure the first portion to the second portion.

The wallet formed from the template may be a multi-fold wallet, in which the template further comprises at least one hinge fold line along which the multi-fold wallet is to be opened and closed in use, the wallet having first and second end sections on either side of the hinge fold line, the at least one hinge portion being spaced from said slit, wherein said slit extends substantially lengthwise with respect to the hinge fold line.

The slit may be curved.

The template may further comprise a further slit in another portion of the template, arranged to form an opening of a further card pocket in another section of the wallet, wherein the further slit is located in an end section of the wallet on a side of the hinge fold line opposite to a side on which said slit is located.

The further slit may extend substantially lengthwise with respect to the hinge fold line.

The template may further comprise a further flap extending from another portion of the template, said further flap being arranged to engage in the further slit when said portions are folded along the at least one wallet edge fold line, thereby to prevent unfolding along said at least one wallet edge fold line.

The further flap may include a further tab portion foldable along a further tab fold line, wherein the further flap is foldable against the portion of the template in which the further slit is provided and the further tab portion is foldable along the further tab fold line and insertable into said further slit, thereby to secure the portion to the other portion.

The further slit may be curved.

The slit and/or the further slits may be respectively openings to an inner pocket in the end sections.

The template may be foldable along the at least one wallet edge fold line to form at least one note pocket, wherein the template comprises at least two segments foldable about the at least one wallet edge fold line, wherein two segments provide side surfaces of the note pocket and the joining of the two segments by the wall edge fold line providing a bottom, whereby the joining of the flap to the first segment at the flap fold line provides a side to the note pocket. This template may further comprise at least three wallet edge fold lines, foldable to provide a divider in the note pocket.

In accordance with a fifth aspect of the present invention, there is provided a wallet having at least one card pocket, formed from a single sheet template, the wallet including: a wallet edge fold line along which first and second portions of the template are folded; a slit in the first portion, arranged to form an opening of a card pocket; and a flap extending from the second portion and engaged with the slit, thereby to prevent unfolding along said wallet edge fold line.

The wallet may be formed from the template of the fourth aspect of the invention and features of the wallet may include any feature deriving from the optional features mentioned above in relation to the fourth aspect.

In accordance with a sixth aspect of the present invention, there is provided a method of making a wallet from a single sheet template, comprising the steps of: folding first and second portions of the template along a wallet edge fold line; securing a flap extending from the second portion in a slit forming an opening of a card pocket, thereby to prevent unfolding along said wallet edge fold line. The template may be the template of the fourth aspect of the invention. The template may have any of the optional features mentioned above in relation to the fourth aspect, and the method may comprise folding or otherwise arranging such a template to result in a wallet. The method may optionally comprise folding the template mentioned above in relation to the fourth aspect, including the optional features, to form the wallet.

The template may be formed of Tyvek® or another suitable sheet material. Advantageously, Tyvek® is strong, resistant to tearing and wears well. It is also resistant to liquid water. The template can also be formed of flexible plastics materials or thin leather, by way of example.

BRIEF DESCRIPTION OF THE FIGURES

For better understanding of the present invention, embodiments will now be described, by way of example only, with reference to the accompanying Figures in which.

Figure 1:
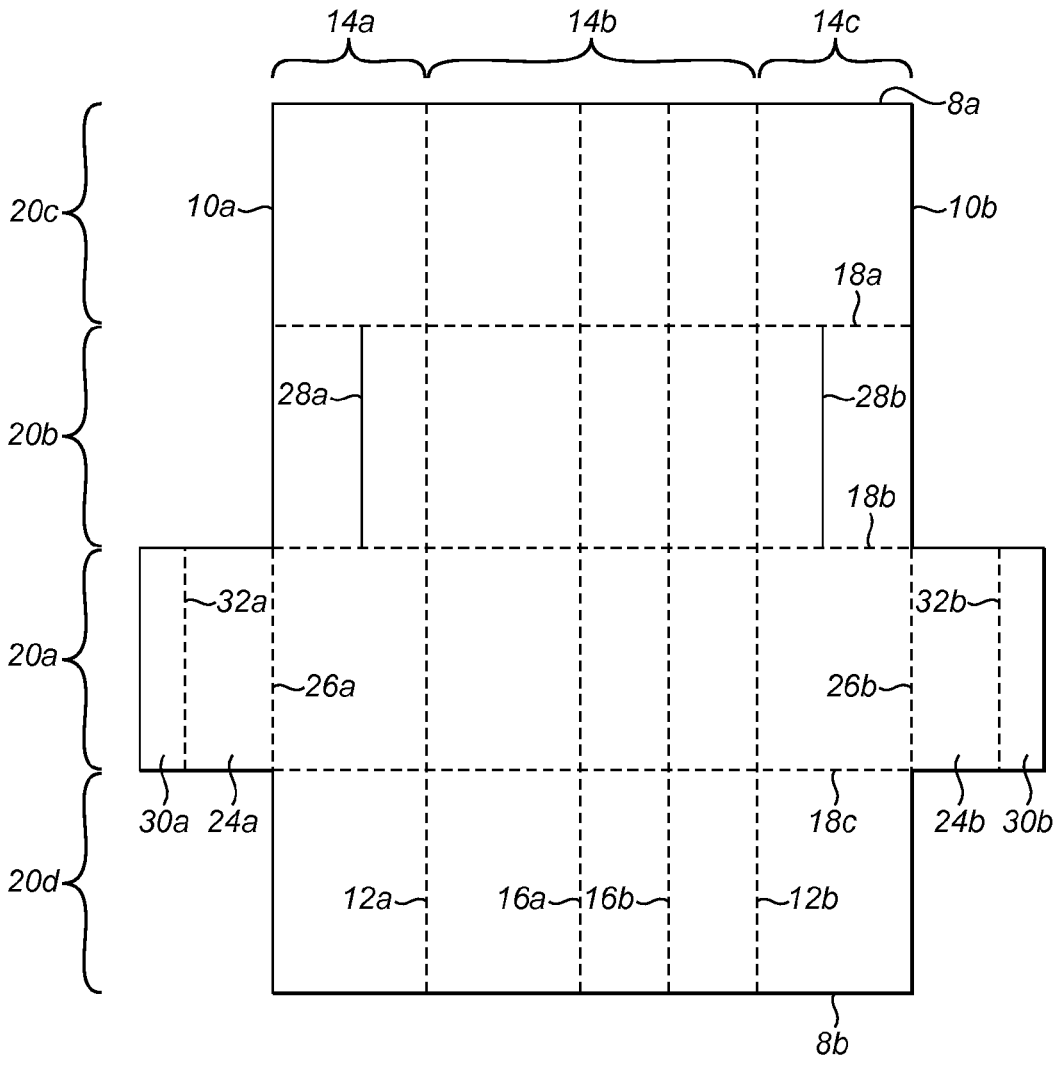
FIG. 1 is a plan view of a template in accordance with an embodiment of the present invention.

The Figures are not necessarily to scale. Accordingly, it should be understood that copies of the Figures with their precise dimensions may not result in templates configured for folding into a wallet.

DETAILED DESCRIPTION OF EMBODIMENTS

Like reference numerals are used to denote like elements throughout.

In the following, a template is described together with a process for constructing a wallet from the template and the resultant wallet. The wallet includes card pockets. It will be understood that the vast majority of cards available are of a standard size, such cards including bank cards, business cards, a driving license, customer loyalty cards, and building access cards. Credit cards are typically 86 mm in length. In the UK at least, travel tickets for underground systems and trains are also conveniently of the same size. Each card pocket is suitable for retaining such cards and tickets. It will be appreciated that the template can be reconfigured for use with other sizes of cards.

In embodiments, the template also includes a note/bill pocket. Similarly, notes are typically of similar sizes, such that the note pocket can be sized to accommodate typical notes.

A trifold wallet opens and closes about two parallel spaced hinges formed of fold lines in the material of the wallet. Although a trifold wallet is described in the following, in other embodiments a bi-fold or other multi-fold wallet may be created from a template with similar features, as will be clear to the skilled person. In any multi-fold wallet, the wallet has at least two end sections. A wallet with two end sections openable and closable along a single hinge fold line is a bi-fold wallet. Where a wallet has one middle section, it is a tri-fold wallet.

Referring to FIG. 1, in an embodiment, a template for a trifold wallet comprises a single sheet in the form of a rectangle having a pair of laterally extending flaps. The rectangle has first and second surfaces, the first surface being the one shown in FIG. 1 and the second surface being underneath. A distance between first and second respectively parallel edges 10*a*, 10*b* is herein referred to as the "template width". A distance between the third and fourth parallel edges 8*a*, 8*b* is herein referred to as the "template length". Two hinge fold lines 12*a*, 12*b* extend transversely to the template width to divide the template into first, second and third sections, indicated at 14*a-c* in FIG. 1. When the template is folded into a wallet, these fold lines 12*a*, 12*b* form hinges of the wallet permitting the wallet to open and close. In the second section, two pocket-forming fold lines 16*a*, 16*b* extend parallel to the hinge fold lines 12*a*, 12*b*.

In modified embodiments, the depth of inner and outer pockets in the second section can be altered by changing the distance between the pocket-forming fold lines 16*a*, 16*b*.

Three further fold lines 18*a*, 18*b*, 18*c*, referred to as "wallet edge fold lines", transverse to the first and second edges 10*a*, 10*b*, divide the template into first, second, third and fourth segments 20*a-d*. The first and second segments 20*a* and 20*b* have a height that is equal to or slightly larger than the height of the cards to be accommodated, depending on how many cards are to be accommodated in each pocket. The third and fourth segments 20*c*, 20*d* have a height equal to or slightly less than segments 20*a* and 20*b* respectively, in order to fit in the depth of the note pocket. It should be understood that the third and fourth segments are sized to extend to the bottom of the note pocket so that the built wallet has a tidy appearance. The third and fourth segments 20*c*, 20*d* together with the first and third wallet edge fold lines serve to provide pocket side forming means, since the folding of these segments 20*c*, 20*d* towards their respective adjacent segment 20*a*, 20*b* forms a side for each of the inner and outer pockets of the second section 14*b*.

The first edges of each of the segments align to form the first edge 10*a* of the rectangle and the second edges of each of the segments align to form the second edge 10*b* of the rectangle. The template includes securing means in the form of first and second flaps 24*a*, 24*b* and first and second slits 28*a*, 28*b*. The first and second flaps 24*a*, 24*b* respectively extend from first and second edges of the first segment 20*a*, and are separated from the first segment 20*a* by flap fold lines 26*a*, 26*b* at the edges.

Portions of the template are separated by the first and second hinge fold lines 12*a*, 12*b* and the first, second and third wallet edge fold lines 18*a-c*. Each portion can be referenced using the first, second and third sections 14*a-c*, and first, second, third and fourth segments 20*a-d*.

Each portion of the second segment 20*b* in the first and third sections 14*a*, 14*c* includes a slit 28*a*, 28*b* therein. Each slit 28*a*, 28*b* extends substantially from the first wallet edge fold line 18*a* to the second wallet edge fold line 18*b*, so as to allow a longer edge of a card to be inserted first. In a variant embodiment, the template and slits can be resized so that a shorter end of a card is inserted first instead of the longer end. When the template is folded into a wallet, these slits 28*a*, 28*b* each form an opening to a respective inner card pocket of the wallet. Each slit 28*a*, 28*b* is located in its respective portion so that, when the template is folded into a wallet, cards can be inserted and removed from the direction of the second section 14*b*. Thus, when the wallet is closed, cards cannot come loose accidentally.

The first and second flaps 24*a*, 24*b* respectively include first and second tab portions 30*a*, 30*b* separated from the rest of the flap by first and second tab fold lines 32*a*, 32*b*. The tab portions 30*a*, 30*b* are sized to fit through respectively the first and second slits 28*a*, 28*b*.

Figure 2A:
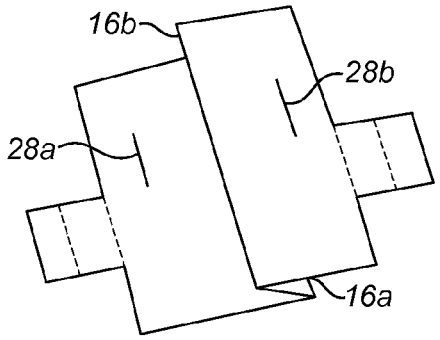
FIGS. 2A to 2I illustrate steps performed in folding the template of the embodiment of FIG. 1 into a wallet.
Figure 2B:
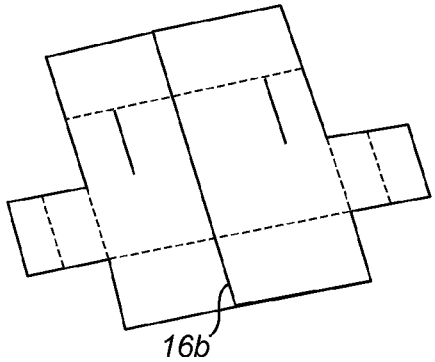

Steps to make a wallet from the template are described in the following with reference to FIGS. 2A to 2I. As shown in FIG. 2A, the template is initially folded in a z-fold along the pocket-forming fold lines 16*a*, 16*b*, so that parts of the second section overlie. The z-folded parts provide inner and outer sheet portions of inner and outer card pockets. Each inner and outer sheet portion is joined at the pocket forming fold line 16*a* to form the bottom of the respective card pocket.

Figure 2C:
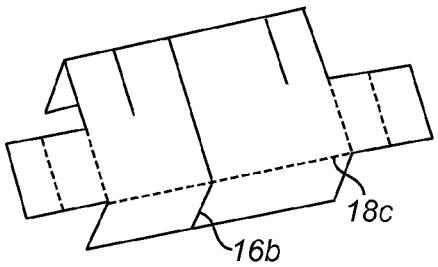
Figure 2D:
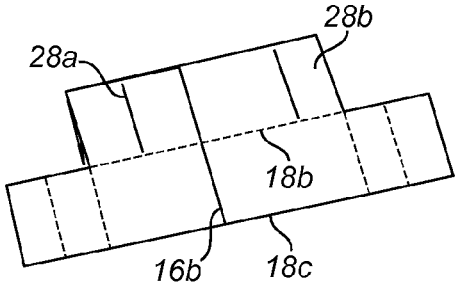

The template is then folded along the first and third wallet edge fold lines 18*a*, 18*c* so that the third and fourth segments 20*c*, 20*d* are folded towards each other. The third and fourth parallel edges 8*a*, 8*b* then lie adjacent, as indicated in FIGS. 2C and 2D. It should be understood that the third and fourth segments 20*c*, 20*d*, together with the first and third wallet edge fold lines 18*a*, 18*c*, provide a side for each of the inner and outer card pockets 17*a*, 17*b* partially formed by the z-fold. The third and fourth segments 20*c*, 20*d* are sized to extend substantially to a bottom of the note pocket 19 whose formation is to be described since this results in a wallet of tidy appearance, but this is not essential to achieve the side for each of these inner and outer card pockets.

Figure 2E:
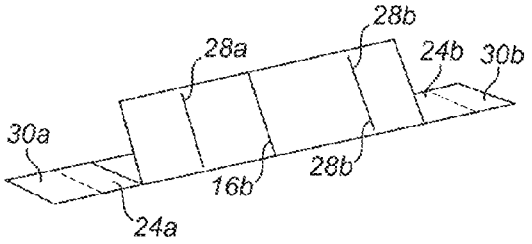
Figure 2F:
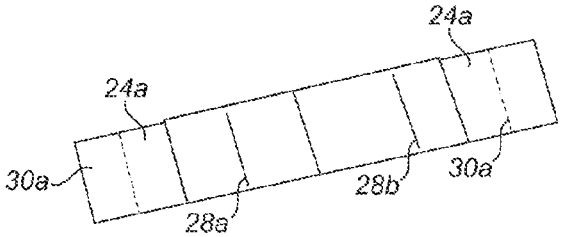

In a next step, as indicated in FIGS. 2E and 2F, the template is folded about the second, central wall edge fold lines 18*b*, so that the third and fourth segments 20*c*, 20*d* are located flush against each other. The folding about the second wallet edge fold line 18*b* creates the other side for each of the inner and outer card pockets 17*a*, 17*b* partially formed by the z-fold.

Figure 2G:
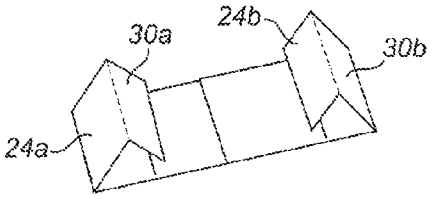

In a next step, as shown in FIG. 2G, the first and second flaps 24*a*, 24*b* are folded in against the second segment 20*b* along the flap fold lines 24*a*, 24*b*. This creates a bottom for each of the third and fourth card pockets 21*a*, 21*b*. The tab portions 30*a*, 30*b* are respectively folded along the tab fold lines 32*a*, 32*b*. Each of the first and second tab portions 30*a*, 30*b* are tucked through a respective slit 28*a*, 28*b* and self-secure therein.

Figure 2H:
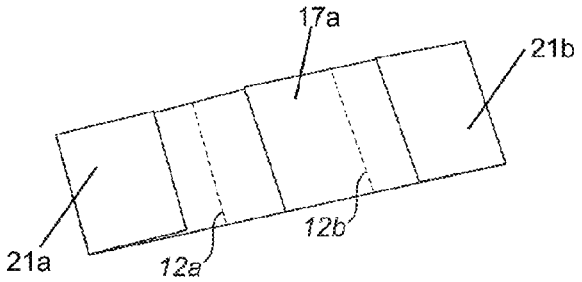
Figure 2I:
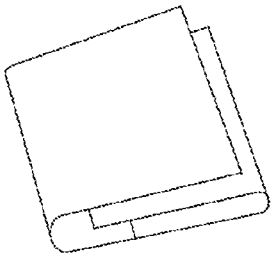

This results in the open wallet shown in FIG. 2H. The wallet can be closed by folding about the fold lines 12*a*, 12*b* in a trifold manner, to result in the wallet shown in FIG. 2I.

Figure 2J:
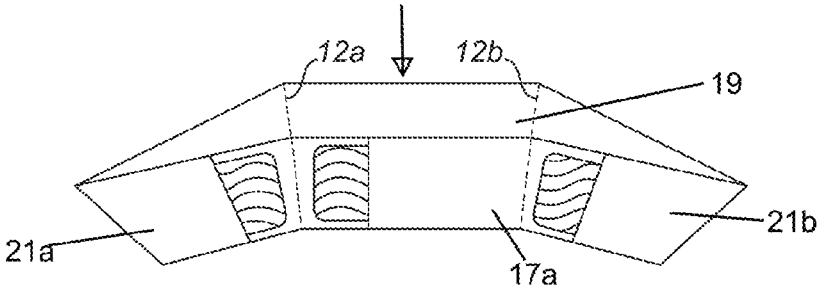
FIGS. 2J and 2K are perspective views of the wallet when open.
Figure 2K:
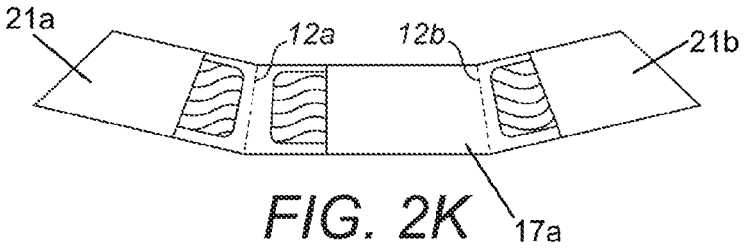

The resultant trifold wallet has three sections, each section corresponding to first, second and third sections 14*a-c* of the template. An inner side of the wallet has three card pockets 17*a*, 21*a*, 21*b*, one in each of the sections 14*a-c*. An outer side of the wallet has one card pocket 17*b*, in a middle second section 14*b*. The openings to the card pockets 17*a*, 17*b*, 21*a*, 21*b* are transverse with respect to the template width, which is the dimension of the open wallet including the first, second and third sections. The resultant wallet also has a note pocket 19, shown in FIG. 2J.

All visible surfaces of the wallet are formed of the first surface. In the above described embodiment, the third and fourth segments are folded towards each other by folding along the first and third wallet edge fold lines so that the first surface is exterior. Subsequently the first and second segments 20*a*, 20*b* are folded together about the second wallet edge fold line 18*b* so that the first surface of the third and fourth segments form the interior of the note pocket. The wallet can alternatively be formed in a mirror image manner by folding the third and fourth segments 20*c*, 20*d* towards each other so that the second surface is on the exterior. If the second surface of the template is to provide the visible exterior surface rather than the first surface, then, in order for the internal and external middle pockets to have a correct depth and position, pocket fold lines 16*a*, 16*b* must either be inverted, or the positions of the folds adjusted so that the pocket is formed correctly.

Also, in an alternative using the same template, the wallet can be folded so that the pockets of the first and third sections 14*a*, 14*c* the wallet are on the outside of the wallet rather than the inside. The flaps can be engaged in the slits as described above to secure the template in the form of a wallet.

Figure 3A:
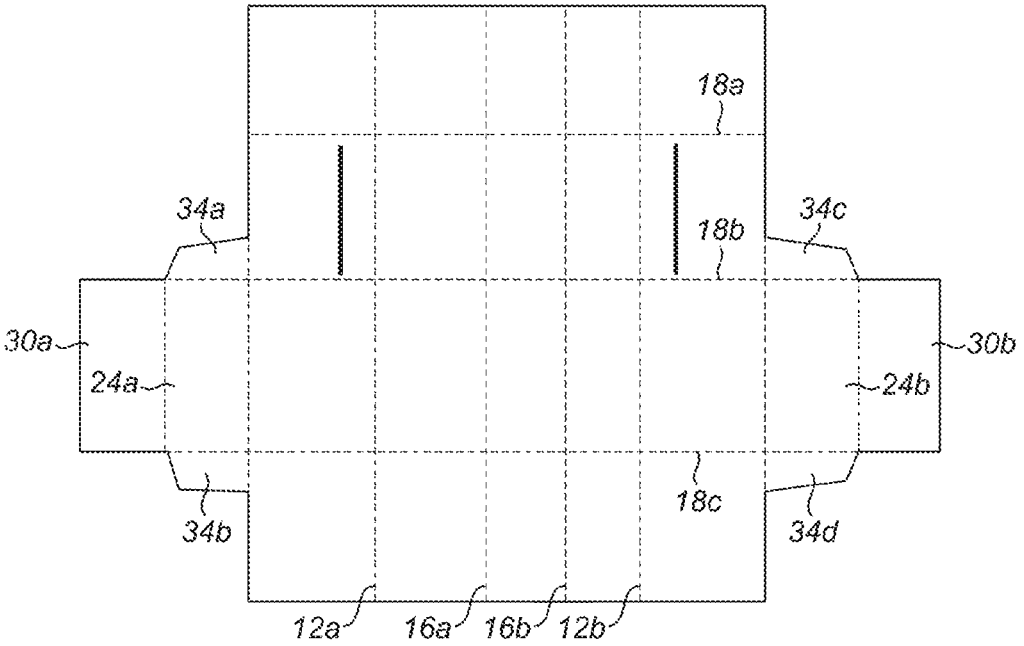
FIG. 3A is a plan view of a template in accordance with a first variant embodiment.

Referring to FIG. 3A, in another embodiment, the flaps are modified to avoid raw sheet edges being visible or touchable by a wallet user. First and second first flap edge concealing wings 34*a*, 34*b* extend from edges of the first flap 24*a* and first and second flap edge concealing wings 34*c*, 34*d* extend from edges of the second flap 24*b*. The second and third wallet edge fold lines 18*b*, 18*c* extend to separate the edge concealing wings from the adjacent flap. Each edge concealing wing is foldable about the respective second or third wallet edge fold line 18*b*, 18*c*, such that a folded edge is visible and touchable by the user. This results in improved appearance and durability.

Figure 3B:
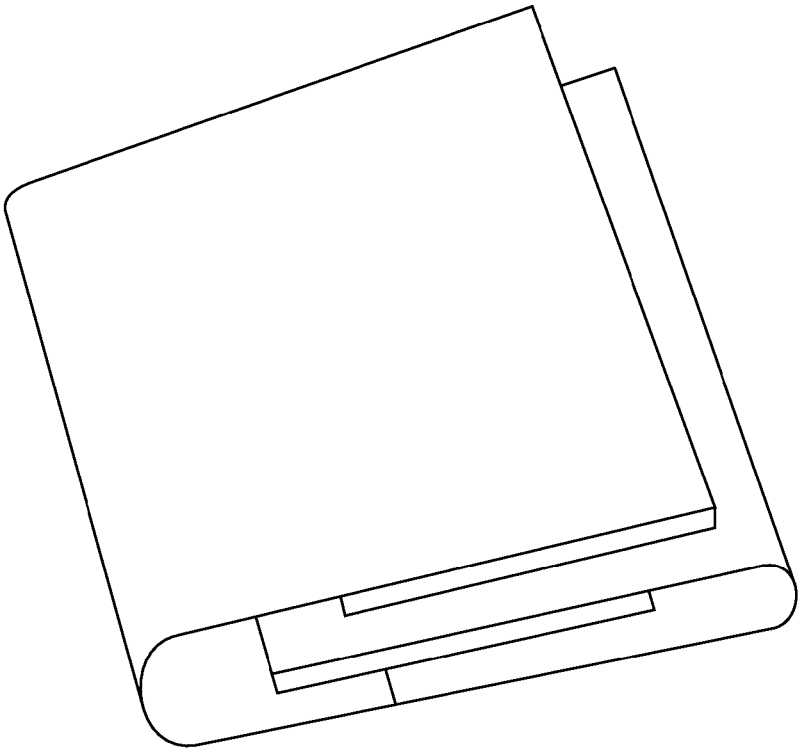
FIG. 3B is a perspective view of a wallet for comparison with the wallet shown in FIG. 3A, without concealing edge pieces.

In FIG. 3B, a wallet without such edge concealing wings is shown, and regions where untidy and potentially raw edges of the sheet may be present are shown in black for comparison.

Figure 4:
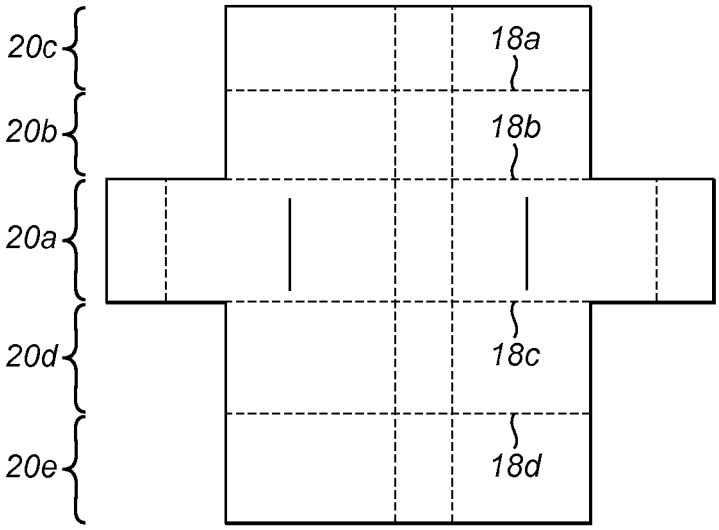
FIGS. 4 to 6 are plan views of templates respectively in accordance with second, third and fourth variant embodiment.

Referring to FIG. 4, in a similar but modified embodiment, the template includes a fifth segment 20*e* adjacent the fourth segment 20*d* and separated therefrom by a fourth wallet edge fold line 18*d*. This segment 20*e* permits the wallet to include a further note pocket.

Figure 5:
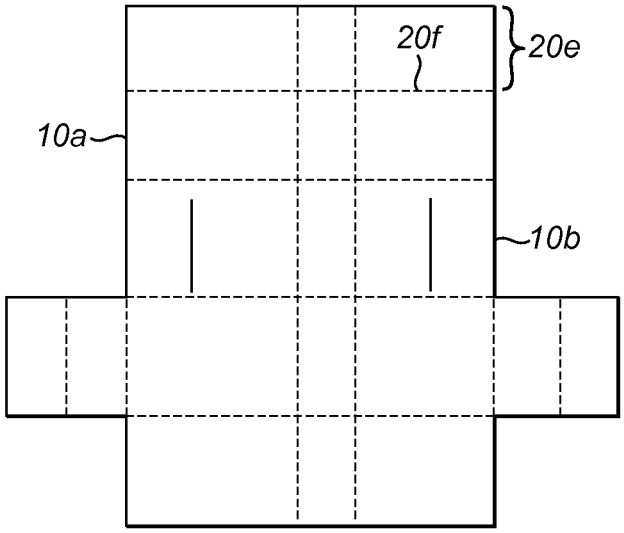

Referring to FIG. 5, in a similar but modified embodiment, the template includes a fifth segment 20*f* located differently to the fifth segment of the embodiment of FIG. 4. The fifth segment is adjacent the third segment 20*c* and separated therefrom by a different fourth wallet edge fold line 20*e*. The fifth segment 20*f* also enables the wallet to include a further note pocket.

Figure 6:
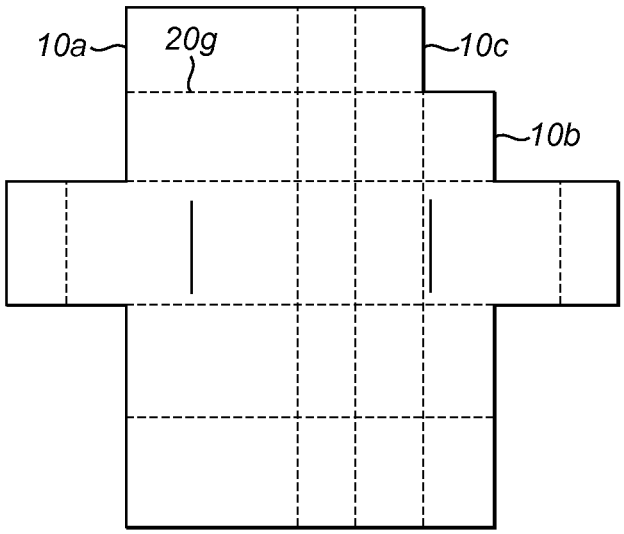

Referring to FIG. 6, like in the embodiment of FIG. 5, the template includes a fifth segment 20*g* located adjacent the third segment 20*c*. However, this segment 20*g* does not extend to the second edge 10*b*, but has an end edge 10*c* extending longitudinally with said second edge 10*b*. The first segment 20*g* is attached along the fourth wallet edge fold line 20*f* from the first edge 10*a* to half the distance from the edge 10*a* to the end edge 10*c*. After this half distance, the fifth segment 20*g* is not attached to the adjacent third segment 20*c*. The fifth segment can be folded so that the end edge 10*c* and the edge 10*a* lie adjacent. When the wallet is build, this results in a second pocket adjacent the note pocket. This template enables the wallet to divide the compartment of the note pocket without having a redundant Z fold in the material forming the divider.

Various modifications can be made to the embodiment described above. The slits are preferably curved. This facilitates insertion of cards into the slits and improves the appearance of the interior of the wallet when cards are not present in the pockets.

Although not shown in the Figures, sides of the tab portions 30*a*, 30*b* may be tapered to facilitate insertion of the tabs in the slits.

In a simple embodiment, the wallet need not be multifold. In this case, hinge fold lines 12*a-c* are not provided. In such a wallet, alternative securing means may be desirable to prevent unfolding along the wallet edge fold lines 18*a-c*, so that the wallet can have length and width corresponding substantially to only a single portion.

The template can be formed of many kinds of sheet material permitting folding, but is preferably made of Tyrex®. Tyrex is a brand name for a synthetic material formed of flashspun, high-density polyethylene fibers. The template may alternatively be made from plastics permitting repeated folding, or finely cut leather, for example.

The applicant hereby discloses in isolation each individual feature or step described herein and any combination of two or more such features, to the extent that such features or steps or combinations of features and/or steps are capable of being carried out based on the present specification as a whole in the light of the common general knowledge of a person skilled in the art, irrespective of whether such features or steps or combinations of features and/or steps solve any problems disclosed herein, and without limitation to the scope of the claims. The applicant indicates that aspects of the present invention may consist of any such individual feature or step or combination of features and/or steps. In view of the foregoing description it will be evident to a person skilled in the art that various modifications may be made within the scope of the invention.

The invention claimed is:

1. A wallet having at least first and second card pockets in opposite surfaces thereof, folded from a single sheet template comprising:

a) first and second pocket forming fold lines folded in a z-fold to form sheet portions of each of first and second card pockets and a bottom for each of the first and second card pockets, the bottom joining said sheet portions;

b) pocket side forming means folded to form a first pocket side edge of each of the first and second card pockets;

c) a wallet edge fold line transverse to the first and second pocket forming fold lines and along which portions of the template are folded to form a second pocket side edge of each of the first and second card pockets;

d) securing means for preventing unfolding along the wallet edge fold line;

e) a first slit extending lengthwise with respect to said hinge fold line in a portion of a first section of the wallet on an opposite side of the hinge fold line to a second section comprising the first and second card pockets, wherein the first slit forms an opening of a third card pocket;

f) a further hinge fold line on a side of the first and second card pockets remote from the hinge fold line, wherein the wallet is foldable about the hinge and further hinge fold lines to open and close.

2. The wallet of claim 1, wherein the hinge fold line is located adjacent and spaced from an opening to said first pocket, whereby disengagement of a card from the first pocket is prevented when the wallet is closed.

3. The wallet according to claim 1, wherein the securing means is folded to prevent unfolding along said wallet edge fold line.

4. The wallet according to claim 1, wherein said pocket side forming means comprises:

two further wallet edge fold lines transverse to said first and second pocket forming fold lines, a one of said further wallet edge fold lines being on respective opposite sides of said wallet edge fold line; and first and second parts folded together along a respective one of said further wallet edge fold lines to respectively form said first pocket side edge of each of the first and second card pockets.

5. The wallet of claim 4, wherein the securing means is also arranged to prevent unfolding along said at least two further wallet edge fold lines.

6. The wallet of claim 1, wherein the securing means comprises a first flap extending from another portion of the first section, arranged for folding into the first slit, thereby to at least partially secure the template folded along at least the wallet edge fold line.

7. The wallet of claim 6, wherein the first flap includes a tab portion folded along a tab fold line, wherein the first flap is folded along a flap fold line against the portion of the first section in which the first slit is provided, and said tab portion is folded along said tab fold line and inserted into the first slit, thereby to secure the template folded along at least the wallet edge fold line.

8. The wallet of claim 7, further comprising an edge concealing portion extending from at least one side of the flap, wherein the wallet edge fold line extends to divide the edge concealing portion from the flap, wherein the edge concealing portion is folded against the flap with the folding of the first and second segments along the wallet edge fold line.

9. The wallet of claim 1, further comprising a second slit extending lengthwise with respect to the further hinge fold line, from a third section of the wallet on an opposite side of the further hinge fold line to the second section comprising the first and second card pockets, wherein the second slit forms an opening of a fourth pocket.

10. The wallet of claim 9, wherein the securing means comprises a second flap folded into the second slit, thereby to at least partially secure the template folded along at least the wallet edge fold line.

11. The wallet of claim 9, wherein the wallet is a tri-fold wallet and the first and/or second slits are respectively openings to an inner pocket in first and third sections of the wallet.

12. The wallet of claim 1, wherein the template is folded along the wallet edge fold line to form a note pocket, wherein the first and second portions joined by the wallet edge fold line form the note pocket.

13. The wallet of claim 12, further comprising at least one yet further fold line substantially parallel to said wallet edge fold line, wherein said yet further fold line is folded to provide a divider in the note pocket.

14. A single sheet template for folding to form a wallet with at least first and second card pockets in opposite surface portions of the wallet, the template comprising:

a) first and second pocket forming fold lines foldable in a z-fold to form sheet portions of each of first and second card pockets and a bottom for each of the first and second card pockets, the bottom joining said sheet portions;

b) pocket side forming means foldable to form a first pocket side edge of each of the first and second card pockets;

c) a wallet edge fold line transverse to the first and second pocket forming fold lines and along which first and second portions of the template are foldable to form a second pocket side edge of each of the first and second card pockets;

d) securing means for preventing unfolding along the wallet edge fold line;

e) a first slit extending lengthwise with respect to a hinge fold line in a portion of a first section of the wallet on an opposite side of the hinge fold line to a second section comprising the first and second card pockets, wherein the first slit forms an opening of a third card pocket; and f) a further hinge fold line on a side of the first and second card pockets remote from the hinge fold line, wherein the wallet is foldable about the hinge fold line and further hinge fold lines to open and close.

15. The template of claim 14, wherein the is located adjacent and spaced from an opening to said inner pocket, whereby disengagement of a card from the inner pocket is prevented when the wallet is closed.

16. The template of claim 14, wherein said pocket side forming means comprises:

two further wallet edge fold lines transverse to said first and second pocket forming fold lines, a one of said further wallet edge fold lines being on respective opposite sides of said wallet edge fold line; and first and second parts foldable together along a respective one of said further wallet edge fold lines to respectively form said first pocket side edge of each of the first and second card pockets.

17. A template of claim 16, wherein the securing means is foldable to prevent unfolding along said wallet edge fold line, and is also arranged to prevent unfolding along said at least two further wallet edge fold lines.

18. A method of making a wallet having at least first and second card pockets in opposite surface portions of the wallet, from a single sheet template, comprising the steps of:

a) folding said template along first and second pocket forming fold lines in a z-fold to form sheet portions of each of the first and the second card pockets and a bottom for each of the first and second card pockets, the bottom joining said sheet portions;

b) folding pocket side forming means to form a first pocket side edge of each of the first and second card pockets;

c) folding portions of the template along a wallet edge fold line transverse to the first and second pocket forming fold lines to form a second pocket side edge of each of the first and second card pockets;

d) securing the template folded along the along the wallet edge fold line to prevent unfolding when the wallet is in use;

e) folding about a hinge fold line, wherein a first slit extending lengthwise with respect to a hinge fold line is located in a portion of a first section of the wallet on an opposite side of the hinge fold line to a second section of the wallet comprising the first and second card pockets, wherein the first slit forms an opening of a third card pocket; and f) folding about a further hinge fold line located on a side of the first and second pockets remote from the hinge fold line, wherein the wallet is foldable about the hinge fold line and the further hinge fold line to open and close.

* * * * *